US006298544B1

(12) United States Patent
Hsu

(10) Patent No.: US 6,298,544 B1
(45) Date of Patent: Oct. 9, 2001

(54) METHOD OF FABRICATING A HIGH FREQUENCY THIN FILM COIL ELEMENT

(75) Inventor: Canon Hsu, Hsin Chu Hsien (TW)

(73) Assignee: Inpaq Technology Co., Ltd., Miao Li Hsien (TW)

( * ) Notice: Subject to any disclaimer, the term of this patent is extended or adjusted under 35 U.S.C. 154(b) by 0 days.

(21) Appl. No.: 09/275,443

(22) Filed: Mar. 24, 1999

(51) Int. Cl.[7] ..... H01P 11/00

(52) U.S. Cl. ..... 29/600; 29/874; 336/96; 336/200; 336/196

(58) Field of Search ..... 29/600, 412, 874, 29/25.42, 602.1; 336/96, 206, 196, 200, 83, 185, 192; 205/118, 119, 122

(56) References Cited

U.S. PATENT DOCUMENTS

| | | | | |
|---|---|---|---|---|
| 4,038,457 | * | 7/1977 | Kinugasa et al. | 428/411 |
| 4,396,899 | * | 8/1983 | Ohno | 338/34 |
| 4,696,100 | * | 9/1987 | Yamamoto et al. | 29/605 |
| 4,992,772 | * | 2/1991 | Kubota et al. | 338/308 |
| 5,228,188 | * | 7/1993 | Badihi et al. | 29/623 |
| 5,359,311 | * | 10/1994 | Kawabata et al. | 336/83 |
| 5,598,621 | * | 2/1997 | Littecke | 29/412 |
| 5,764,126 | * | 6/1998 | Kanetaka et al. | 336/96 |
| 5,853,558 | * | 12/1998 | Gray et al. | 205/119 |
| 5,963,119 | * | 10/1999 | Takeda et al. | 336/206 |
| 6,154,112 | * | 11/2000 | Aoba et al. | 336/192 |
| 6,157,283 | * | 12/2000 | Tsunemi | 336/192 |

FOREIGN PATENT DOCUMENTS

| | | | | |
|---|---|---|---|---|
| 0238104 | * | 10/1986 | (JP) | 29/600 |
| 0265413 | * | 11/1988 | (JP) | 29/600 |
| 11346450 | * | 11/1999 | (JP) . | |

* cited by examiner

*Primary Examiner*—Lee Young
*Assistant Examiner*—Minh Trinh
(74) *Attorney, Agent, or Firm*—Dougherty & Troxell

(57) ABSTRACT

Disclosed herein is a method of fabricating a high frequency thin film coil element having a main coil body composed of a rod shaped ceramic substrate, a thin metallic film layer covering the ceramic substrate, a conductor layer covering the thin metallic film layer, and a plurality of notches which being cut from the conductor layer down to the substrate thereon, and conductor terminals provided at two sides of the main coil body. A protecting layer covering the main body and an anti-oxidation layer, being cut in the similar way as the conductor layer, are sandwiched between the conductor and protecting layers of the main coil body.

6 Claims, 10 Drawing Sheets

METHOD OF FABRICATING A HIGH FREQUENCY THIN FILM COIL ELEMENT

BACKGROUND OF THE INVENTION

1. Field of the Invention

The present invention relates to a method of fabricating a high frequency thin film coil element, and more particularly, to a method with high quality and low production cost.

2. Description of the Prior Art

As the growth of radio communication is so rapid that almost completely takes over the position of wired communication, the frequencies are also rising higher and higher, and the requirements for coils with good high frequency: characteristic, such as high accuracy with minimum errors, high Q quality, low resistance, and very high self-resonance frequency . . . etc. increase day after day. However, most of the coil manufactures in this field have been able to contribute to meet the above requirements by providing high frequency coils of excellent quality.

Now, the fabricating methods of two of the most commonly used high frequency coil elements are described briefly hereinafter:

1. Thin film laminated, spirally loop shaped high frequency coil element (see FIGS. 1A–1U:

The steps of fabricating this type of coil element comprise: forming a metallic conductor film 101 (FIGS. 1C, 1D) by a proper deposition process on both surfaces of a ceramic or glass substrate 100 (FIGS. 1A, 1B) which is cut to form a minimum unit chip; then perform the first lay spiral segment circuit and conducting pad Ly lithography technologies; the other surface also performing the similar processes as those of the first surface to form a spirally looped main body, and then reserving a connecting terminal 103 (FIGS. 1E, 1F). In each of the steps mentioned above, electro plated layers 104, 105 (FIGS. 1G, 1H) are formed on conductor surfaces of the main body for increasing the thickness of the conductor thereby reducing the resistance and improving low resistance characteristic. Then afterward, selecting a certain material with low dielectric constant to form an insulation protecting layer 106 on the main body surface, and reserving the space for the conductor terminal and the space for a connecting hole 107 at the center of the spirally looped main body as well for the purpose of forming a connecting film thereof to complete fabrication of a first loop coil element after connection of the connecting film to the other terminal. Again, similar to the step of fabricating the first layer of spirally looped conductor shown in FIG. 1E, a second conductor film 108 and an electro plated layer 109 are formed on the protecting layer 106 so as to connect the central point of spiral loop to the other terminal thereby forming a complete coil (FIGS. 1H–1N). Next, covering the spirally looped main body with a protecting layer 110 (FIGS. 1P, 1Q), and attaching a lead wire 111 for the terminal on each of both sides of the substrate between the two poles after cutting the substrate thereby to complete fabrication of a basic coil element (FIGS. 1R, 1S). Finally, the coil element is electro plated, and an interface layer is attached to the lead wire according to various usages so the all fabrication steps come to the end (FIGS. IT, 1U).

As it can be seen from the above description, such fabrication steps are quite complicated and expensive.

2. Metallic conductor (copper) wire wound type high frequency coil element (refer to FIGS. 2A~2C):

This type of coil element is fabricated on a specially shaped, single unit ceramic substrate 201. The required terminal 202 for connecting with conductor is already prepared thereon. A varnished insulation copper wire 203 is wound around the ceramic substrate 201 by means of a specially designed winding machine and the wire terminals 2004 at two ends are connected to a reserved position (FIG. 2B). Finally, a cover layer 205 is applied to protect the coil thereby completing fabrication of a coil element (FIG. 2C).

To shallowly think it seems that fabricating such a coil is so easy that the only thing to do is to wind the varnished insulation wires on the substrate, yet it involves several problems remaining unsolved, namely:

A. The cost for raw materials becomes high as a very specially made substrate is used.

B. Winding varnished insulation wires around the substrate by means of a specially designed winding machine results in high equipment cost but inefficient production speed.

C. Though the size of winding affects the coil characteristic greatly, the operation of winding machine can not effectively control the size of winding resulting in a poor yield rate, and finished products have to go through checking and classification procedures again.

As described above, the conventional methods of fabricating high frequency coils have a number of unsolved problems which result in high production cost and expensive product price which the customer has to suffer from.

Having determined to solve these problems, the inventor of the present invention has studied for a long time trying to find out if there by any possibility to develop a new product able to overcome the difficulties which the conventional products and technology encountered and finally succeeded in providing high frequency thin film coil element and method of fabricating the same which will now be disclosed herein.

SUMMARY OF THE INVENTION

It is an object of the present invention to provide high frequency thin film coil element and method of fabricating the same which can sharply reduce the production cost and increase the performance quality of the product by simplifying and stabilizing the method of fabrication thereby enabling the customer to enjoy the use of low price, high quality products.

To achieve the above object, gist of the present invention is directed to provide a high frequency thin film coil element comprising a main coil body composed of a rod shaped ceramic substrate, a thin metallic film layer covering the ceramic substrate, a conductor layer covering the thin metallic film layer, and a plurality of notches being cut from the conductor layer down to the substrate thereon, interface layers for conductor terminals provided at two side of the main coil body; a protecting layer covering the main coil body; and an anti-oxidation layer being cut as the conductor layer sandwiched between the conductor layer and the protecting layer of the main coil body, and the method of fabricating the same.

BRIEF DESCRIPTION OF THE DRAWINGS

The drawings disclose illustrative embodiments of the present invention which serve to exemplify the various advantages and objects hereof, and are as follows.

DETAILED DESCRIPTION OF THE PREFERRED EMBODIMENT

Figure 1A:
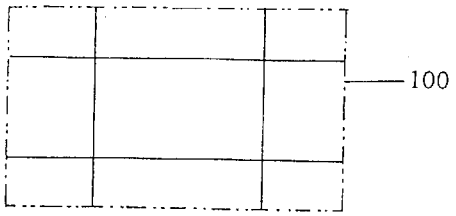
FIG. 1A ( PRIOR ART )
FIGS. 1A–1U are drawings illustrating fabrication steps of a conventional thin film laminated spirally loop shaped high frequency coil element.
Figure 1B:
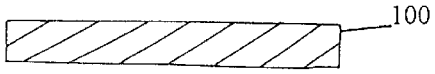
FIG. 1B ( PRIOR ART )
Figure 1C:
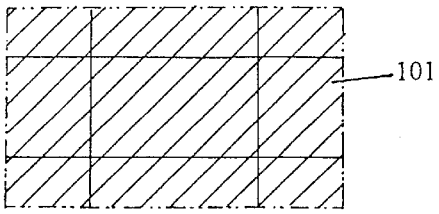
FIG. 1C ( PRIOR ART )
Figure 1D:
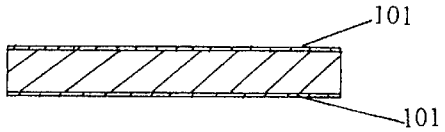
FIG. 1D ( PRIOR ART )
Figure 1E:
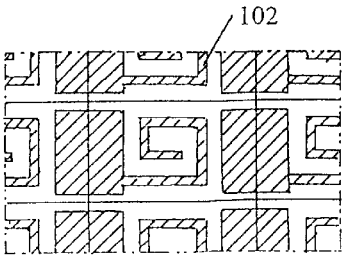
FIG. 1E ( PRIOR ART )
Figure 1F:
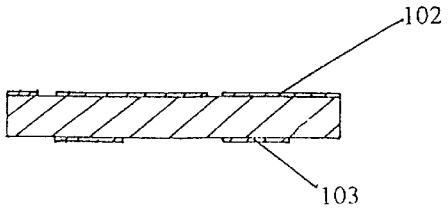
FIG. 1F ( PRIOR ART )
Figure 1G:
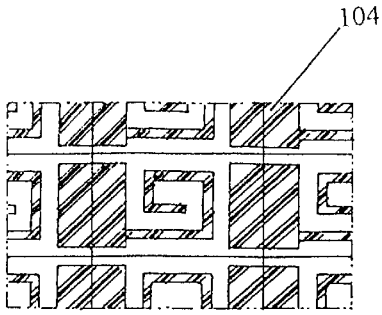
FIG. 1G ( PRIOR ART )
Figure 1H:
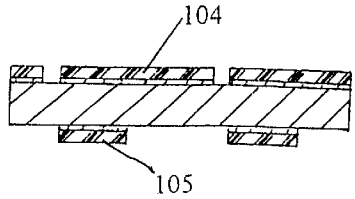
FIG. 1H ( PRIOR ART )
Figure 1I:
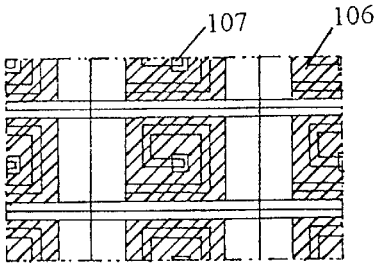
FIG. 1I ( PRIOR ART )
Figure 1J:
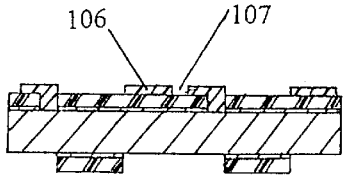
FIG. 1J ( PRIOR ART )
Figure 1K:
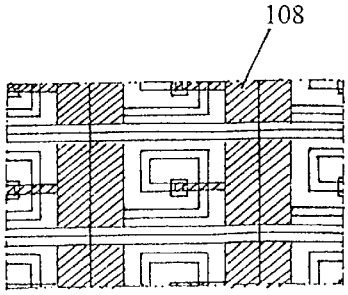
FIG. 1K ( PRIOR ART )
Figure 1L:
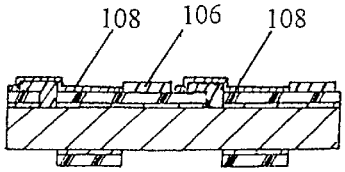
FIG. 1L ( PRIOR ART )
Figure 1M:
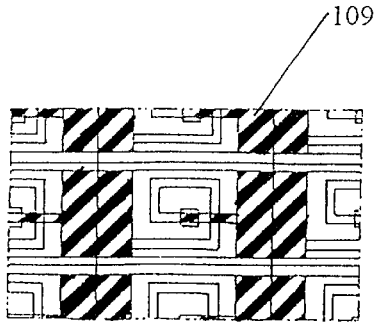
FIG. 1M ( PRIOR ART )
Figure 1N:
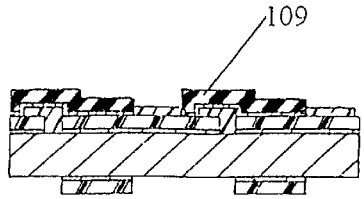
FIG. 1N ( PRIOR ART )
Figure 1P:
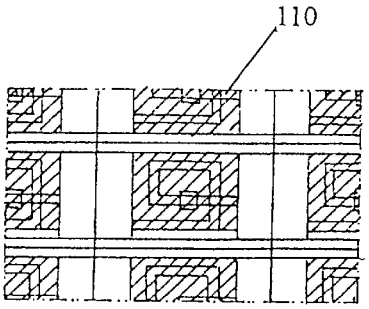
FIG. 1P ( PRIOR ART )
Figure 1Q:
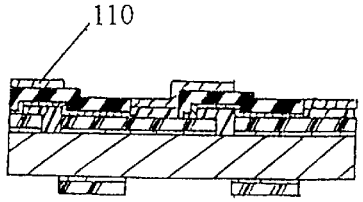
FIG. 1Q ( PRIOR ART )
Figure 1R:
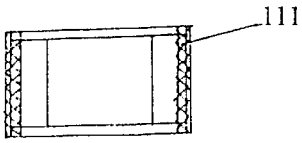
FIG. 1R ( PRIOR ART )
Figure 1S:
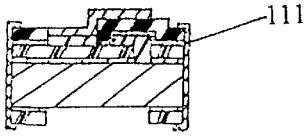
FIG. 1S ( PRIOR ART )
Figure 1T:
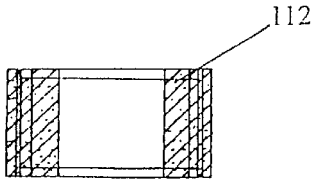
FIG. 1T ( PRIOR ART )
Figure 1U:
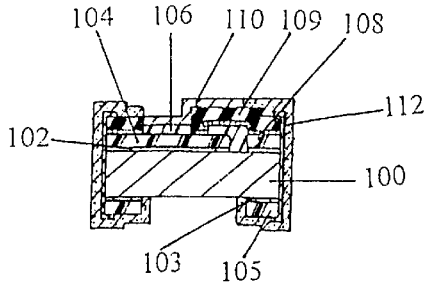
FIG. 1U ( PRIOR ART )
Figure 2A:
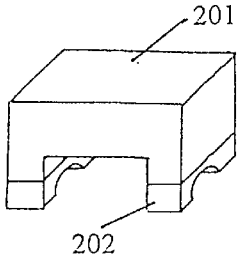
FIG. 2A ( PRIOR ART )
FIGS. 2A–2C are drawings illustrating fabrication steps of a conventional metallic conductor (copper) winding type high frequency coil element.
Figure 2B:
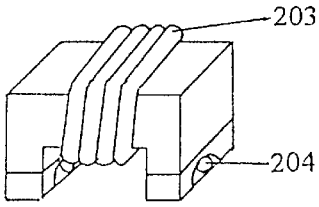
FIG. 2B ( PRIOR ART )
Figure 2C:
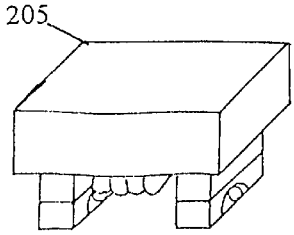
FIG. 2C ( PRIOR ART )
Figure 3:
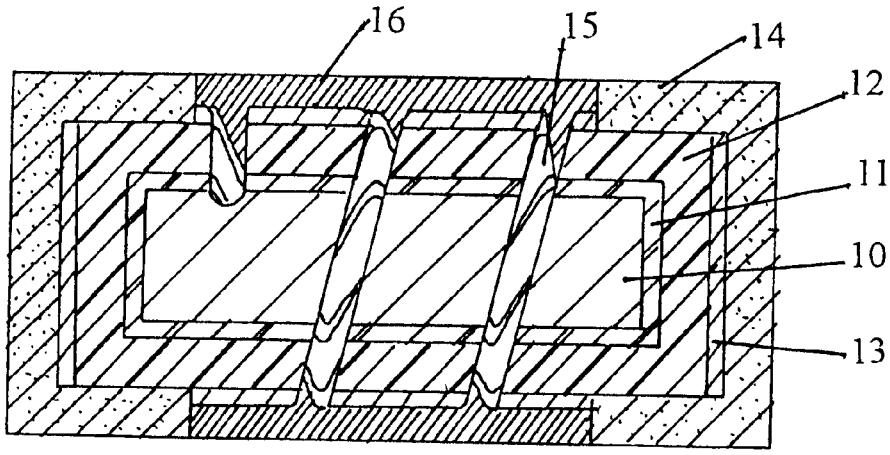
FIG. 3 is a drawing showing structure of the high frequency thin film coil element in an embodiment of the present invention.

Referring to FIG. 3 showing structure of the high frequency thin film coil element is an embodiment of the present invention, according to the drawing, the coil element comprises a main coil body composed of a rod shaped ceramic substrate 10, a thin metallic film layer 11 covering the substrate 10, a conductor layer 12 covering the metallic thin film layer 11, and a plurality of notches 15 being cut from the conductor layer 12 down to the substrate 10 thereon; interface layers for conductor terminals 17 provided at two sides of the main coil body; a protecting layer 16 covering the main coil body; and an anti-oxidation layer 13, being cut as the conductor layer 12, sandwiched between the conductor layer 12 and the protecting layer 16 of the main coil body. Substrate 10, thin metallic film layer 11, conductor layer 12 and anti-oxidation layer 13 being all cut through and form a successive spiral structure covering the main coil body. Further to this, the interface layers for conductor terminals 17 provided at both sides of the main coil body are formed into metallic caps 14 serving as conductor terminals.

Referring to FIGS. 5A~5G, the method of fabricating a high frequency thin film coil element comprises the steps of:

1. Taking a piece of rod shaped ceramic material as a substrate 10, and depositing a thin metallic film layer 11 on the ceramic substrate 10 by means of thin film deposition technology, for example: e-gun, sputtering, chemical vapour deposition . . . and so on.
2. Forming a low resistance conductor layer 12 (such as a cooper layer) on the surface of the thin metallic film layer 11 by electro plating process;
3. Forming an anti-oxidation layer 13 (such as a resin layer) on the electro plated conductor (copper) layer 12 to prevent possible oxidation of the conductor layer 12 during the following steps;
4. Attaching a metallic cap 14 on each side surface of the substrate 10 for serving as a conductor terminal, in order to make the metallic cap 14 firmly in contact with the conductor layer 12, the size of the cap 14 shall be precisely adjusted and corresponding contact part of the anti-oxidation layer 13 shall be removed;
5. Cutting the cylindrical half-finished product from the conductor layer 12 down to the substrate 10 thereon by means of a hard cutter blade, for example, a diamond or a sic cutter blade, to form a plurality of notches 15 thereby forming the conductor layer 12 into a spiral figured coil body on the substrate 10;
6. Forming a protecting layer 16 on the main coil body between the two metallic caps 14, and completing the fabrication of the high frequency thin film coil element of the present invention. Perhaps it might be pointed out that step 5 of cutting the coil body is analogous to that of cutting a conventional metallic conductor winding type coil element, however, the fabrication step of the present invention can be carried out more precisely than the conventional step by numeric control process or instrumentation so as to obtain products with better quality.

Figure 4:
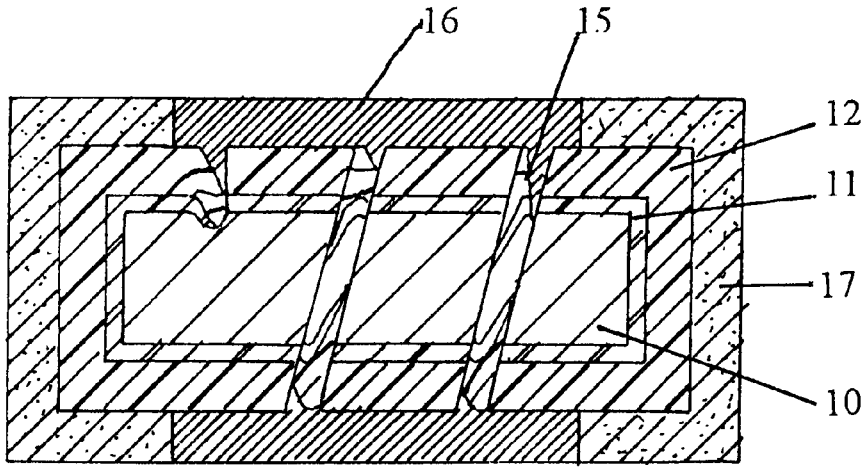
FIG. 4 is a drawing showing structure of the high frequency thin film coil element in another embodiment of the present invention.
Figure 5A:
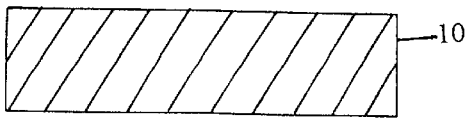
FIGS. 5A~5G are successive drawings illustrating fabrication steps of the high frequency thin film coil element in an embodiment of the present invention.
Figure 5B:
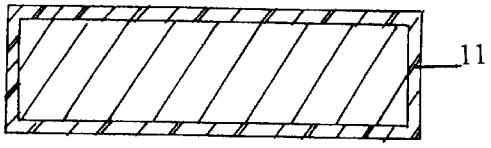
Figure 5C:
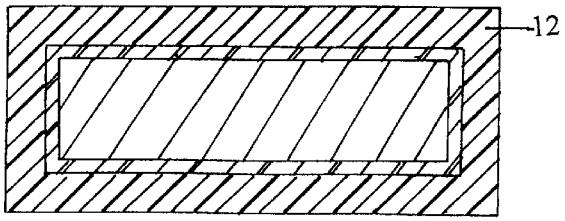
Figure 5D:
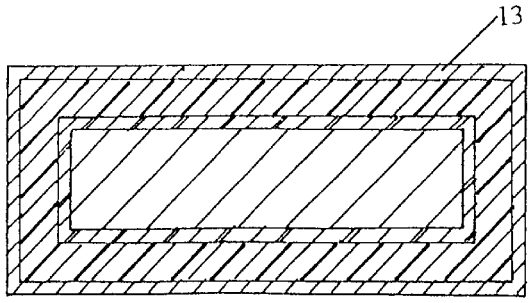
Figure 5E:
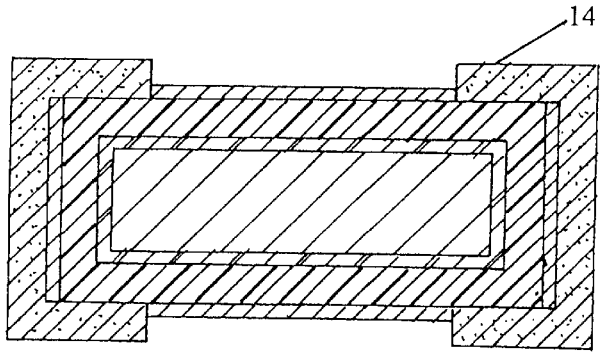
Figure 5F:
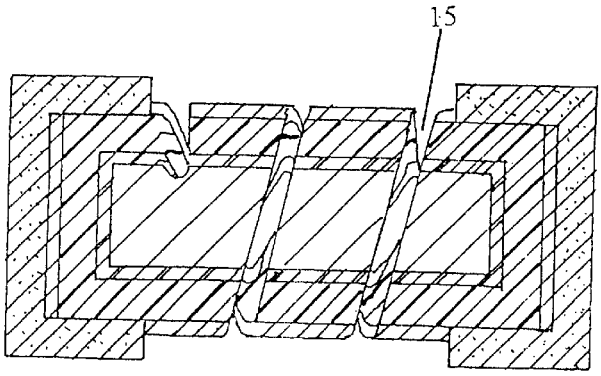
Figure 5G:
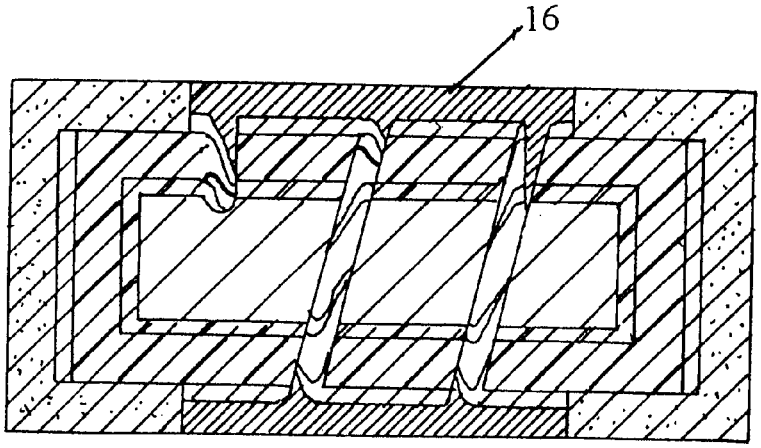
Figure 6A:
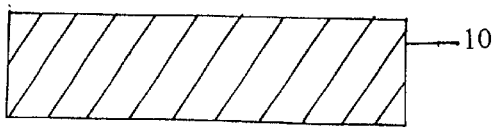
FIGS. 6A~6F are successive drawings illustrating fabrication steps of the high frequency thin film coil element in another embodiment of the present invention.
Figure 6B:
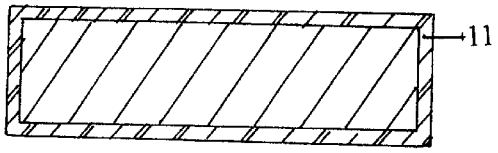
Figure 6C:
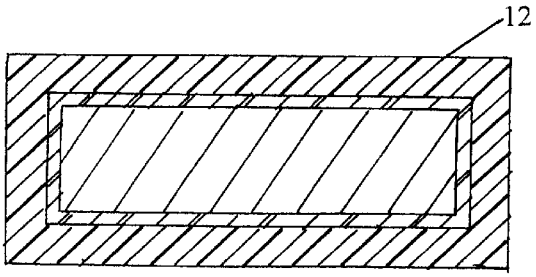
Figure 6D:
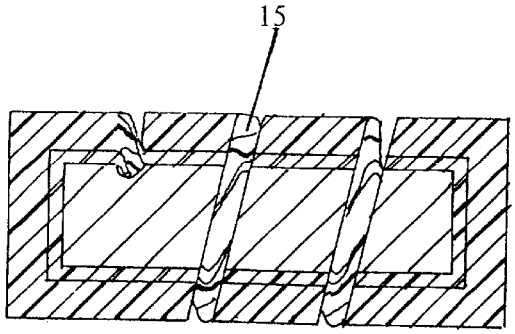
Figure 6E:
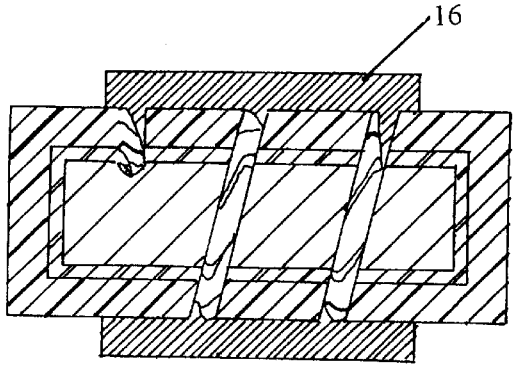
Figure 6F:
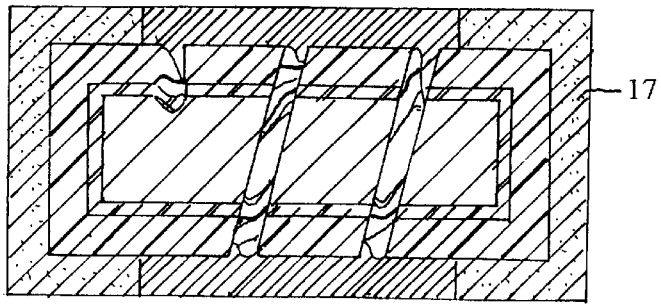

Another embodiment of the present invention is shown in FIG. 4, wherein the coil element comprises a main coil body, the interface layers for conductor terminals 17 provided at both sides of the main coil body, and a protecting layer 16 covering the main coil body, but the anti-oxidation layer 13 shown in FIG. 3 (a first embodiment of the present invention) is omitted.

FIGS. 6A~6F are successive drawings illustrating fabrication steps of the coil element in another embodiment of the present invention. The main differences between the first and the second embodiments are:

1. In the second embodiment, the anti-oxidation layer is omitted (skipping the step shown in FIG. 5D).
2. In the second embodiment, there are no metallic caps provided.
3. In the second embodiment, cutting step of the main coil body is performed after covering the main coil body with the protecting layer 16. Before forming the protecting layer 16, the required space for installing conductor terminal is reserved, and then the interface layer 17 is formed by electro plating process.

Finally, the advantages of the present invention are concluded as follows:

1. Since the processes utilized by the present invention, for example, sputtering deposition technology is popularly and inexpensively used by other industries for mass production, and copper electro plating is also inexpensive and may entrust a specialized satellite workshop to perform so as to prevent environmental contamination of the main factory, the high quality products can be obtained with a low mass production cost.
2. As some of the materials such as the ceramic substrate and the metallic cap are also used by other industries, the present invention may therefore enjoy using low cost materials.
3. Diamond and sic cutter blades are very common inexpensive tools suitable for rapid automatized mass production thereby can sharply reduce the production cost and share benefit with the customer by providing him with low price coil elements.

It should be understood that the invention may be embodied in other specific forms without departing from the spirit of the essential characteristics thereof. The present embodiments are therefore to be considered in all respects as illustrative and restrictive, the scope of the invention being indicated by the appending claims rather than by the foregoing description and all changes which come within the meaning and range of equivalency of the claims are therefore intended to be embraced therein.

What is claimed is:

1. A method of fabricating a high frequency thin film coil element comprising the steps of:

providing a round shaped ceramic rod as a substrate;

depositing a thin metallic film layer thereon;

forming a conductor layer on a surface of said thin metallic film layer by electroplating; and forming a plurality of spiral notches by cutting said conductor layer down to said ceramic substrate by a hard cutter blade.

2. The method as claimed in claim 1, wherein the step of depositing the thin metallic film layer is by e-beam deposition.

3. The method as claimed in claim 1, comprising the further step of forming an anti-oxidation layer, and cutting the anti-oxidation layer the same way as said conductor layer.

4. The method as claimed in claim 1 wherein the step of depositing the thin metallic film layer is by vacuum evaporation.

5. The method as claimed in claim 1 wherein the step of depositing the thin metallic film layer is by chemical vapor deposition.

6. The method as claimed in claim 1 wherein the step of depositing the thin metallic film layer is by sputtering.

* * * * *